United States Patent [19]

Post et al.

[11] Patent Number: 4,494,329

[45] Date of Patent: Jan. 22, 1985

[54] ARRANGEMENT FOR DETERMINING THE PRESENCE OF A CARTRIDGE IN A CARTRIDGE CHAMBER OF A WEAPON

[75] Inventors: Lothar Post, Düsseldorf; Bernhard Schneider, Monchen-Gladbach, both of Fed. Rep. of Germany

[73] Assignee: Rheinmetall GmbH, Dusseldorf, Fed. Rep. of Germany

[21] Appl. No.: 535,391

[22] Filed: Sep. 23, 1983

[30] Foreign Application Priority Data

Oct. 22, 1982 [DE] Fed. Rep. of Germany ..... 3239093

[51] Int. Cl.[3] ..... F41C 27/12

[52] U.S. Cl. ..... 42/1 D

[58] Field of Search ..... 42/1 D

[56] References Cited

U.S. PATENT DOCUMENTS

| | | | |
|---|---|---|---|
| 439,551 | 10/1890 | Pheatt | 42/1 D |
| 808,463 | 12/1905 | Luger | 42/1 D |
| 1,459,284 | 6/1923 | Declaye | 42/1 D |
| 3,024,453 | 3/1962 | Ransom | 42/1 D |

*Primary Examiner*—Charles T. Jordan

[57] ABSTRACT

A cartridge casing detection system for detecting the presence or absence of a cartridge casing in the cartridge chamber of a machine cannon. A lever is pivotally mounted in a recess of the housing of the weapon. A sensor is connected to a switch. One free end of the lever is adapted to coact with the sensor tip and the other free end of the lever is adapted to coact with the edge of the cartridge casing when the latter is disposed in the cartridge chamber of a weapon. A breech block is reciprocally mounted in the weapon and includes a pocket past which the other free end may extend for contacting the cartridge casing when the breech block is in its forwardmost operative position.

4 Claims, 2 Drawing Figures

ARRANGEMENT FOR DETERMINING THE PRESENCE OF A CARTRIDGE IN A CARTRIDGE CHAMBER OF A WEAPON

BACKGROUND OF THE INVENTION

The invention relates to an arrangement for determining the presence of a cartridge or a cartridge casing in a chamber of an automatic weapon, in particular a machine cannon.

Such machine cannons require, for a safe operation, a cartridge chamber interrogation, in order to prevent, in the case of an occupied cartridge chamber, the introduction of the next following cartridge.

In a machine cannon of the state of the art attempts to effectuate the cartridge interrogation by means of a manual visual control arrangement have been made. Such state of the art arrangements includes a radial bore in the original cartridge chamber, which extends through the weapon housing and the gun barrel, through which, with the aid of a rod, the cartridge chamber can be scanned.

This manual interrogation has the drawback that no control signal can be released by it, so that a timely switching off of the drive of the automatically operating weapon is not possible. On the other hand, the unavoidable erosions, which occur in the gun barrel of the state of the art by way of metallic particles which separate from the wall surfaces thereof and which are entrained by the exploding gases through the bore and lodge in the gap between the exterior wall of the gun barrel and the interior wall of the housing surrounding the gun barrel, prevent a smooth slidable mounting of the gun barrel in the housing and make the construction of such gun barrel more difficult.

SUMMARY OF THE INVENTION

It is an object of this invention to provide an arrangement for determining the presence of cartridges in a cartridge chamber of an automatic weapon in which the aforedescribed drawbacks of the state of the art are avoided and which effectuates a safe firing. The undesired seating in the cartridge chamber of a cartridge casing is automatically detected and malfunctioning is prevented by immediately switching off the drive of the weapon. A further malfunctioning by spearing the following cartridge, is thereby also avoided.

Thus the arrangement of the invention substitutes the manual sight control by means of an automatic sight control, so that it is also possible to release certain switching processes.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
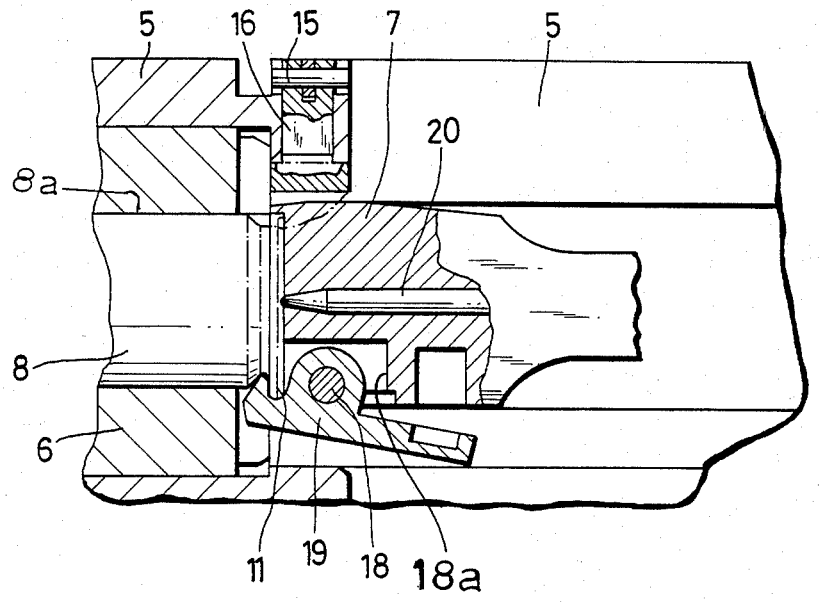
FIG. 1 is a vertical longitudinal sectional view through the rear portion of a gun barrel.
Figure 2:
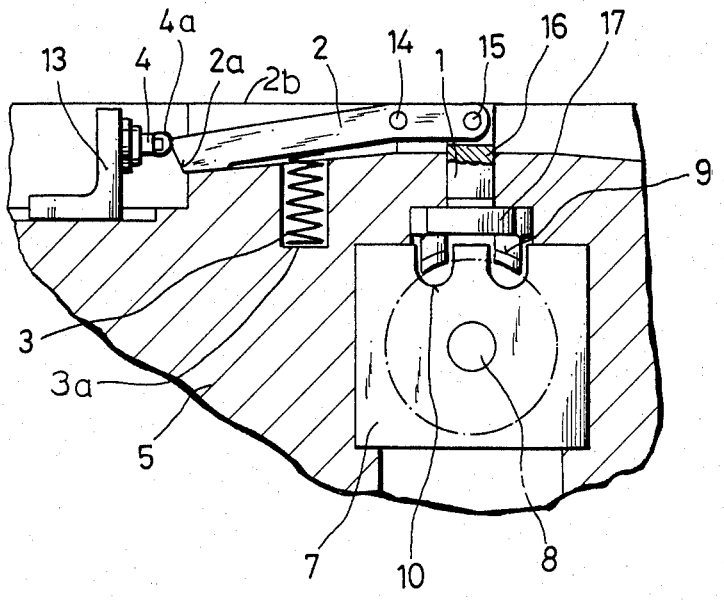
FIG. 2 is a vertical lateral cross-sectional view illustrating portions of the housing of the weapon and of the gun barrel.

The pressure member 1 is slidably mounted in a mating bore of the housing and includes a vertical portion 16 and a lateral portion 17 from which a pair of feeler arms 9 extend downwardly into pockets 10 of the breech block 7. The feeler arms 9 are therefore capable of scanning the bottom 11 of the cartridge casing 8. The vertical portion 16 of the pressure member 1 is pivotally connected via a bolt 15 to the lever 2, which in turn is pivotally connected by means of a pivot pin 14 secured therein in the housing 5 in a recess **2*b* of the weapon housing 5. The swing lever 2 has an inclined contacting surface 2*a* which contacts the sensor tip 4*a* of a switch element 4, which is affixed by means of an angle piece 13 on the weapon housing 5. A spring 3 is mounted within a recess 3*a* in the weapon housing 5 in the region between the sensor tip 4*a* and the pivot pin 14 and is biased against the swing lever 2. The swing bolt 15 is maintained in an operative position by means of tapered bearings. An igniting needle 20 is operatively disposed in the breech block 7. There is furthermore pivotally mounted an extractor lever 19 by way of a pivot pin 18, which is secured in the recess 18*a* of the breech block 7**.

MANNER OF OPERATION

When the arrangement is in a condition "open-breech" the feeler arms 9 extend, as a result of the force exerted by the spring 3, into the loading chamber **8*a* in the region of the bottom thereof. When a cartridge casing 8 is introduced into the cartridge chamber 8*a*, the feeler arms 9 slide along its peripheral surface, whereby the lever 2 is pivoted and actuates, with its inclined surface 2*a*, the sensor tip 4*a*. The feeler arms 9 remain at the radial edge of the cartridge bottom 11. Thereby there is possible at any time an interrogation of the condition of the cartridge chamber 8*a* with respect to the presence or absence of a cartridge disposed therein, because when there is no cartridge casing 8 in the chamber 8*a*, the lever 2 automatically pivots to its non-operative position by the action of the spring 3**.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. An arrangement for determining the presence or absence of a cartridge casing in a cartridge chamber of a weapon, in particular a machine cannon, comprising in combination, a housing having a recess, a lever pivotally mounted in said recess of said housing about an axis which is parallel to the gun barrel axis of the weapon, said lever having a first feeler arm which is adapted to extend into the cartridge chamber to thereby detect the presence of a cartridge casing in said cartridge chamber; and including a breech block operatively slidably mounted in said weapon, said breech block having a pocket, said lever having a second feeler arm, sensor switch means operatively mounted in said housing and adapted to coact with said second feeler arm, biasing means operatively mounted in said housing and biasing said second feeler arm away from said sensor switch means, whereby when a cartridge casing is seated in said cartridge chamber and the breech block is in the forwardmost operative position the edge of the bottom of the cartridge casing projects past the bottom of said pocket of said breech block thereby contacting said first feeler arm and pivotally biasing said second feeler arm against said sensor switch means against the action of said biasing means.

2. The arrangement for determining the presence of a cartridge casing in the cartridge chamber of a weapon as set forth in claim 1, including a pressure member slidably mounted in said housing and being pivotally connected to said first feeler arm, said pressure member having a pair of fingers projecting towards the bottom of the pocket of said breech block when the latter is in the forwardmost operative position thereby contacting the edge of the bottom of the cartridge casing; said breech block having a recess, an extractor lever pivotally mounted in said breech block and being adapted to remove a spent cartridge from said cartridge chamber.

3. The arrangement for determining the presence of a cartridge casing in the cartridge chamber of a weapon as set forth in claim 2, wherein said second feeler arm has an inclined contacting surface at its free end which surface is adapted to contact said sensor switch means.

4. The arrangement for determining the presence of a cartridge casing in the cartridge chamber of a weapon as set forth in claim 3, wherein said housing has a further recess, said biasing means includes a coil spring which is operatively mounted in said further recess, said coil spring is in contact with said second feeler arm of said lever between the free end of said second feeler arm and the pivotal mounting of said lever.

* * * * *